US012453397B2

(12) United States Patent
Fleischer et al.

(10) Patent No.: US 12,453,397 B2
(45) Date of Patent: Oct. 28, 2025

(54) BAG FOR ELECTRONIC DEVICES

(71) Applicants: HUMANFACTORX S.R.L., Dalmine (BG) Brooklyn (IT); Vivienne Fleischer, Brooklyn, NY (US); HUMANFACTORX S.R.L. START-UP COSTITUITA A NORMA DELL'ART .4C LEGGE 24 GENNAIO 15, Dalmine (BG) (IT)

(72) Inventors: Vivienne Fleischer, Brooklyn, NY (US); Michele Bellani, Dalmine (BG) (IT)

(73) Assignees: Vivienne Fleischer, Brooklyn, NY (US); HUMANFACTORX S.R.L., Dalmine (IT)

( * ) Notice: Subject to any disclaimer, the term of this patent is extended or adjusted under 35 U.S.C. 154(b) by 47 days.

(21) Appl. No.: 18/253,297

(22) PCT Filed: Oct. 14, 2021

(86) PCT No.: PCT/IB2021/059437

§ 371 (c)(1),
(2) Date: May 17, 2023

(87) PCT Pub. No.: WO2022/112878

PCT Pub. Date: Jun. 2, 2022

(65) Prior Publication Data

US 2024/0008613 A1 Jan. 11, 2024

(30) Foreign Application Priority Data

Nov. 30, 2020 (IT) ..... 102020000029096

(51) Int. Cl.

| | |
|---|---|
| ***A45C 13/00*** | (2006.01) |
| ***A45C 7/00*** | (2006.01) |
| ***A45C 13/02*** | (2006.01) |
| ***A45C 13/06*** | (2006.01) |
| ***A45C 13/10*** | (2006.01) |
| *A45C 11/00* | (2006.01) |

(52) U.S. Cl.
CPC ..... *A45C 13/005* (2013.01); *A45C 7/0022* (2013.01); *A45C 13/02* (2013.01);
(Continued)

(58) Field of Classification Search
CPC ..... A45C 2011/003; A45C 2011/002; A45C 7/0022; A45C 13/02; A47B 9/16; A47B 9/00; A47B 21/0314
(Continued)

(56) References Cited

U.S. PATENT DOCUMENTS 2,743,550 A * 5/1956 Felice ..... A47B 23/043 248/457
7,828,260 B2 * 11/2010 Hauser ..... A47B 23/043 248/920

(Continued)

FOREIGN PATENT DOCUMENTS

CN 111174038 5/2020
GB 2558679 A 7/2018

OTHER PUBLICATIONS

Search Report for International Application No. PCT/IB2021/059437 dated Jul. 1, 2022.

*Primary Examiner* — Christopher Garft
(74) *Attorney, Agent, or Firm* — Chrisman Gallo Tochtrop LLC

(57) ABSTRACT

A bag for electronic devices, characterised in that it comprises a pair of facing rectangular flaps, which are provided with respective appendixes, having a semi-cylindrical profile, at one end of their long side, and with a couple of cylindrical hinges arranged in the proximity of said long side of the flap at the other end, in the inner surface, an arm 8 being fixed to each said cylindrical hinges, said arm 8 being connected to a frame through a central pivot, both being arranged on the edge of the short side of said bag.

12 Claims, 20 Drawing Sheets

(52) U.S. Cl.
CPC ..... *A45C 13/06* (2013.01); *A45C 13/1069* (2013.01); *A45C 11/003* (2025.01); *A45C 2013/025* (2013.01); *A45C 2200/15* (2013.01)

(58) Field of Classification Search
USPC ..... 248/419, 277.1, 164, 431–432, 439, 248/454–457, 460–463; 108/145
See application file for complete search history.

(56) References Cited

U.S. PATENT DOCUMENTS

| | | | | |
|---|---|---|---|---|
| 8,724,312 | B2 * | 5/2014 | Jones | G06F 1/1632 361/679.44 |
| 2004/0134734 | A1 * | 7/2004 | Hollingsworth | A45C 5/06 190/110 |
| 2004/0163912 | A1 * | 8/2004 | Hollingsworth | A45C 5/06 190/110 |
| 2007/0221811 | A1 * | 9/2007 | Hauser | A47B 23/043 248/454 |
| 2010/0294909 | A1 * | 11/2010 | Hauser | B42D 9/00 248/456 |
| 2015/0114880 | A1 * | 4/2015 | Hough | A45C 11/00 206/755 |
| 2016/0045003 | A1 * | 2/2016 | Chen | A45C 13/02 224/247 |
| 2016/0192750 | A1 | 7/2016 | Han | |
| 2016/0206064 | A1 * | 7/2016 | Chen | A45C 13/02 |
| 2021/0212425 | A1 * | 7/2021 | Wang | A47B 23/043 |
| 2021/0401142 | A1 * | 12/2021 | Rivera | A45C 13/02 |

* cited by examiner

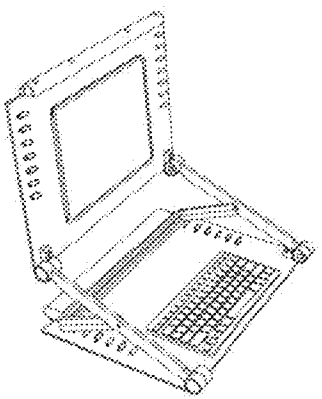
Fig. 17c
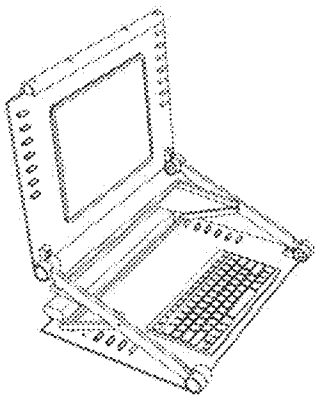
Fig. 17b
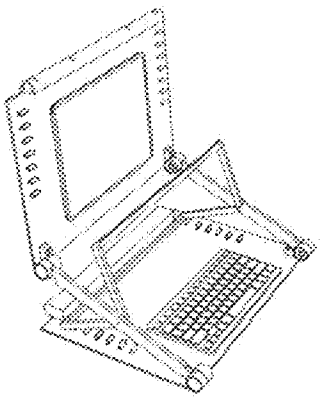
Fig. 17a
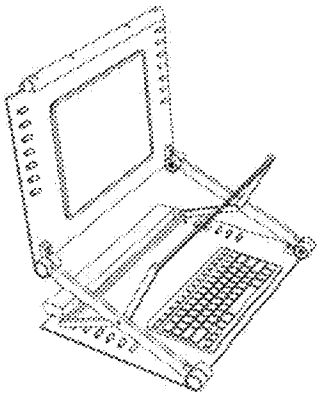

BAG FOR ELECTRONIC DEVICES

CROSS-REFERENCE TO RELATED APPLICATIONS

This is a National Stage application of PCT international application PCT/IB2021/059437, filed on Oct. 14, 2021, which claims priority from Italian Patent Application No. 102020000029096, filed on Nov. 30, 2020, both which are incorporated herein by reference in their entirety.

FIELD OF THE INVENTION

The present invention relates to a bag for carrying electronic devices which turns into an artifact for the installation of an optimal ergonomic workstation in any condition the user finds himself operating.

BACKGROUND OF THE INVENTION

Globally, laptops and tablets are the most commonly used devices for work and for leisure. In the wake of COVID-19 with millions of people now working from home, the daily use of laptops and tablets is at an all-time high.

While laptops and tablets provide convenience and portability, allowing companies to successfully transition to new working-from-home modes, the ergonomic issues related to the use of such devices remain and, in fact, are on the rise.

Furthermore, COVID-19 emergency has dramatically impacted the way people work. At the moment, most of the employees work from home, and it is expected that when it is safe to return to the office, millions of them will continue to work at home or divide their time between the office and home, relying even more on devices such as laptops, tablets and smartphones, which while being portable and practical also pose many ergonomic challenges to users.

Particularly, the inventors noted that the screen height of the laptop represents a critical issue: for most of the users, if the laptop is placed on a work surface (e.g. a table or a desk) at the proper height to ensure safe typing on the integrated keyboard and use of the integrated touch pad (i.e. keyboard at or slightly below elbow height, with the upper arms upright), then the screen height is too low to ensure a healthy and balanced posture, both sitting and standing. Likewise, if the user decides to raise the laptop using a support (riser) to position its screen into an ergonomically healthy viewing height, then the keyboard and touchpad will be too high causing the shoulders and arms to lift and extend during their use.

Furthermore, the studies has shown that many users place the laptop at about an arm's distance away to better view the screen, when using the laptop on a desk or flat surface. This results in flaring the arms out and forward, along with rounding the spine to reach the keyboard and view the screen at the same time.

Therefore, with the aim to reduce the risk of unhealthy ergonomic attitudes, it is an object of the invention to provide a solution which allows the user to work in an ergonomic position, regardless of where he is using his electronic device.

Another ergonomic consideration deserves tablets, which are even more inherently challenging than laptops in that their keyboard is imbedded onto the screen (touch-keyboard), and the interactions with the screen require physical contact through fingers or a stylus pen. Therefore, to view and interact with the screen, the user need to hold the tablet in their hands. And if they want to text or type anything, they must hold the tablet with both hands, and only use their thumbs for keying, or hold the tablet with one hand and type with the other, putting stresses on both hands and arms.

Furthermore, if the user wants to avoid holding the tablet, then they place it on a flat surface which causes excessive rounding of the spine and forward flexion of the neck to view the screen.

These ergonomic issues have brought the inventors, ergonomists by profession, to create an easy to use, light and portable solution, which facilitates a real and correct ergonomic adjustment of the used devices according to international standard and literature. That is, a single product suitable for both tablets and laptops, which can be customized according to a user's needs, with particular attention to the usability of all the elements composing it, which is usable in a simple way and in any work environment such as in the office, at home and even while travelling.

Devices for lifting the support surface of a laptop (or notebook), as described in CN 111174038, are known in the art. There, an upper frame body and a lower frame body are provided, equipped with vertical movement pantograph means, having adjustable heights according to need, the lifting system also providing spring means to allow the most rapid and effective adjustment.

Similarly, GB2558679 describes a support for electronic devices which comprises various spaces for housing accessories and a platform apt to be placed in various positions, which is in turn designed with measures which allow its correct positioning according to the request. In particular, both a lectern structure and a lifting structure are provided, equipped, in order to be supported, with rods to be placed empirically between the raised platform and the base of the support.

However, such devices are cumbersome to manufacture, have a series of bulky accessories to be transported for modifying the use from tablet to laptop, present various critical points in their preparation and in the realization of a healthy ergonomic posture, and can prove to be particularly complex to be installed in uncomfortable working situations, for example on a moving train or in not appropriately prepared areas, such as benches or the like.

BRIEF SUMMARY OF THE INVENTION

Object of the invention is to realize a bag for carrying electronic devices which is light-weighted, effective, truly portable, allowing the user to carry additional accessories such as keyboard, mouse, stylus pen, etc. meanwhile being quick to be prepared, with no risk of breaking cumbersome regulation systems, and with no difficulties of preparation in case of unconventional work environment.

For example, the height adjustment system to position the laptop or tablet screen at the correct height with respect to the eye line, has been designed to be simple and self-explanatory, but at the same time stable and user-friendly for different age groups, even for children.

Said object is achieved realizing a bag for electronic devices characterized in that it comprises a pair of rectangular flaps provided with respective appendixes having semi-cylindrical profile, at one end of their long side, and with a couple of cylindrical hinges arranged in the proximity of said long side of the flap, at the other end, in the inner surface, an arm being fixed to each of said cylindrical hinges, said arm being connected to a frame through a central pivot, both being arranged on the edge of said bag short side.

BRIEF DESCRIPTION OF THE DRAWINGS

The invention is more clearly described in the accompanying drawings, wherein:

FIGS. 12*a* to 12*d* are views showing a first solution provided for the accommodation of external devices inside the case;

FIGS. 17*a* to 17*c* are views of a different solution of the support system of the upper flap when in the working position;

DESCRIPTION OF EXAMPLE EMBODIMENTS

Figure 1:
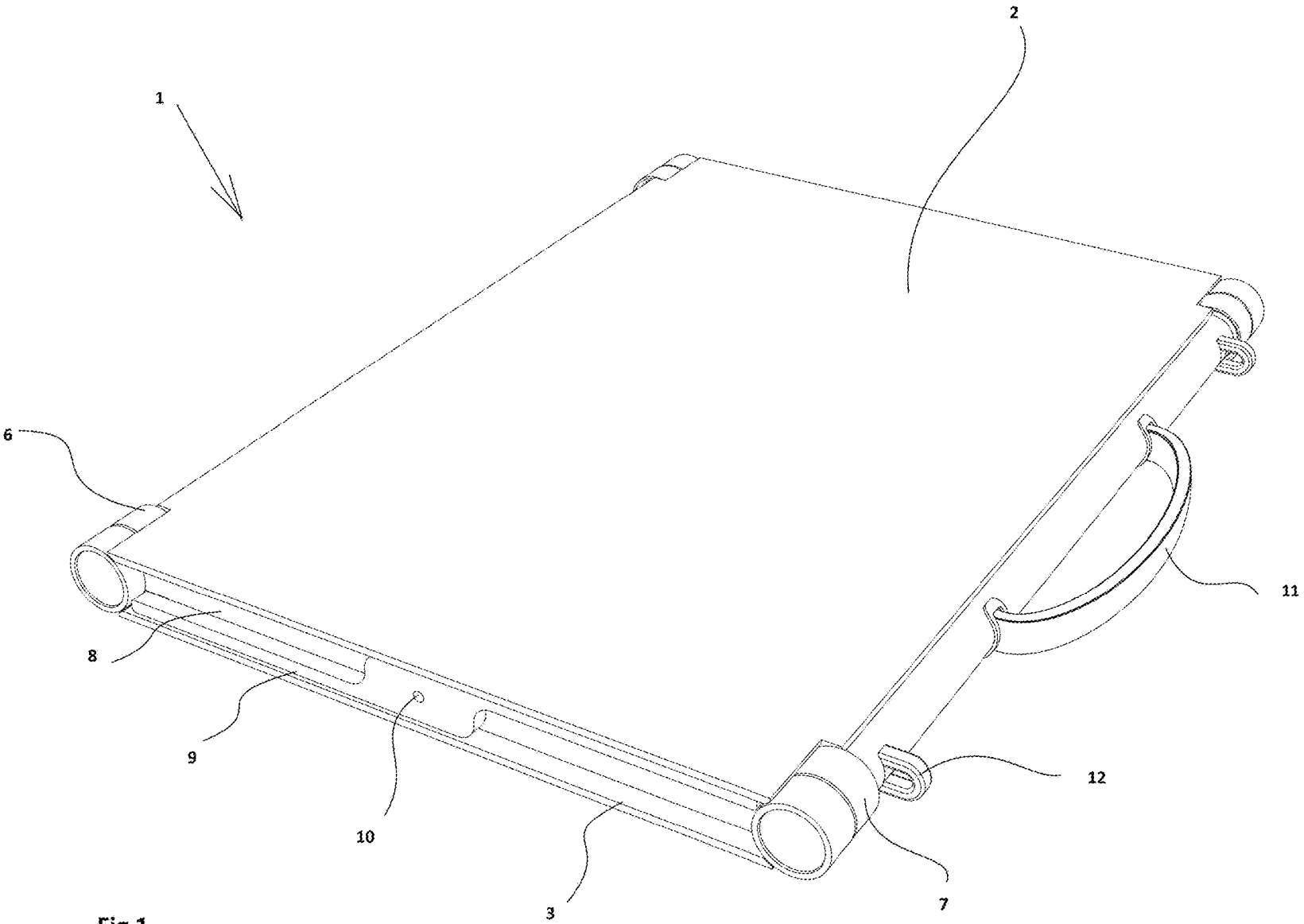
FIG. 1 is a perspective view of the case according to the invention in the rest position.

The bag 1 according to the invention comprises a pair of facing rectangular flaps 2, 3, provided with respective appendixes 4, 5 having semi-cylindrical profile, at one end of the long side, and with a couple of cylindrical hinges 6, 7, arranged in the proximity of said long side of the flap at the other end, in the inner surface.

The appendixes 4, 5 are sufficiently long to meet said cylindrical hinges 6, 7, so to precisely close the case that makes up the bag 1.

Fixed to each of said cylindrical hinges 6, 7 is an arm 8, which is connected to a frame 9 through a central pivot 10, both being arranged on the edge of the short side of said bag. When the two flaps are in the rest position, the association of said arm 8 and the corresponding pivoted side of the frame 9 defines the lateral surface of the bag, the arm 8 and the frame 9 overlapping each other to protect the contents of the bag itself.

A mechanical or magnetic closing system is provided in both flaps 2, 3, arranged in the appendix 5 in the space under the handle 11 and the slots 12, or in the cylindrical lateral hinges 6, 7, such as for example buttons to be pressed or levers to be pulled and/or pushed to release both flaps 2, 3, arms 8 and other elements of the bag. Keys or other technological and digital systems can be used to lock/unlock the opening system.

In this particular configuration, a handle 11 and two slots 12 are provided along this end, in order to offer the correct transport of the electronic device from one place to the other, inside the bag. It appears clear that these elements are not specifically required, and so they could be absent in a different configuration of the same embodiment.

Figures 2A, 2B, 2C, 2D, 2E, 2F, 2G, 2H:
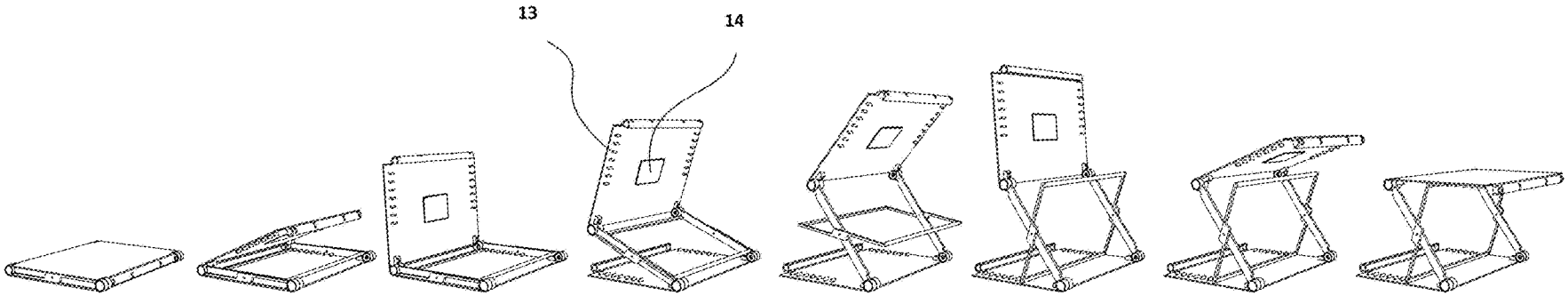
FIG. 2*a* to FIG. 2*h* are perspective views showing the various positions assumed by the case to arrive to the working position.

As illustrated in FIG. 2, notches 13 are provided inside the flaps 2, 3, arranged in two parallel rows and apt to house the frame 9, as will be better described below. Furthermore, a plate 14 is provided at the centre of the flap 2, apt to engage a possible tablet.

The figure illustrates the bag transformation operation to make the computer work on the upper surface of the upper flap: the user opens the flap 2 and raises the arm 8. Then, he rotates the frame 9 to insert it into the notches of the two flaps. By choosing the shape the user determines the height of the flap 2. At this point, the raiser is ready to work.

Figure 4:
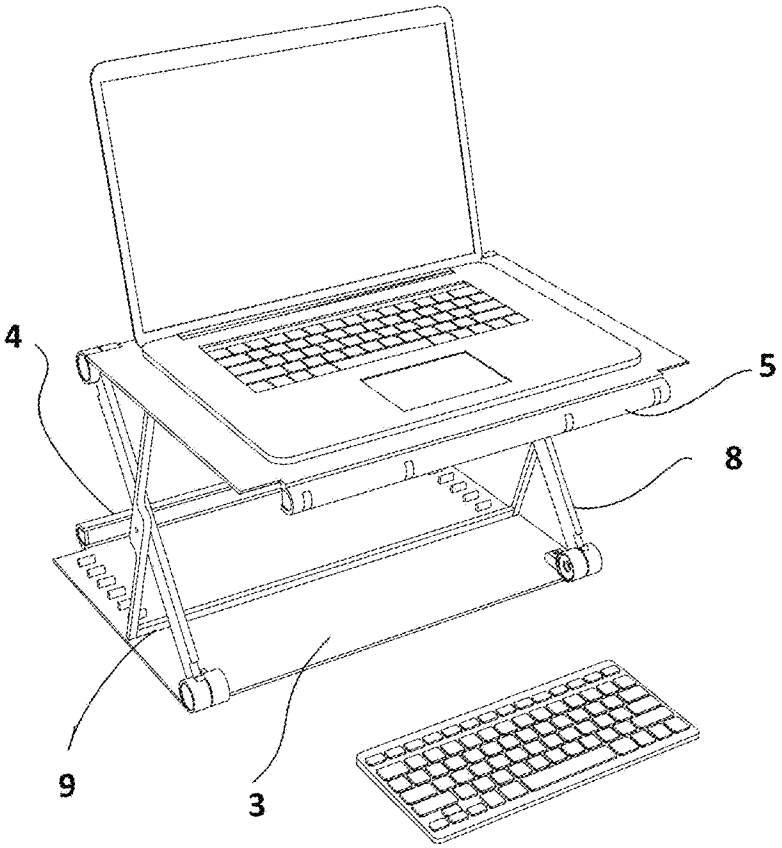
FIG. 4 is a perspective view of the embodiment of FIG. 3, in the work position.
Figure 3:
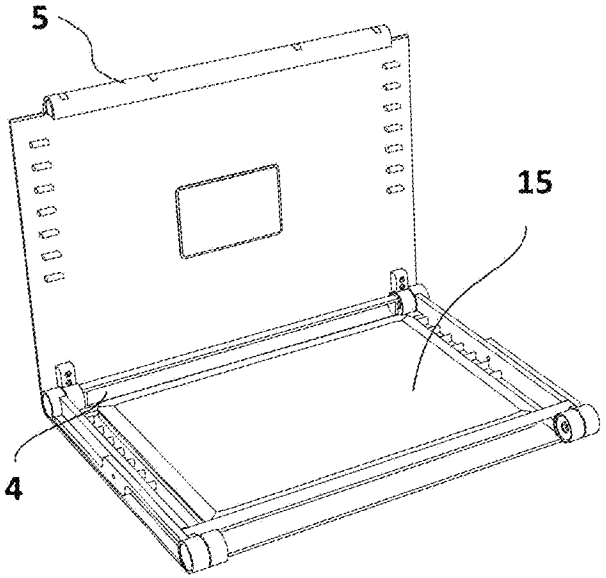
FIG. 3 is a perspective view of a first embodiment of the invention, apt to accommodate a laptop.

In case the bag contains a computer, as illustrated in FIG. 3, the computer 15 is housed inside the surface defined by the frame 9. For making it operational, the user can simply proceed as described above: when the upper flap is in the correct horizontal position, the user can place the computer on said flap upper surface, as illustrated in FIG. 4.

Figure 5:
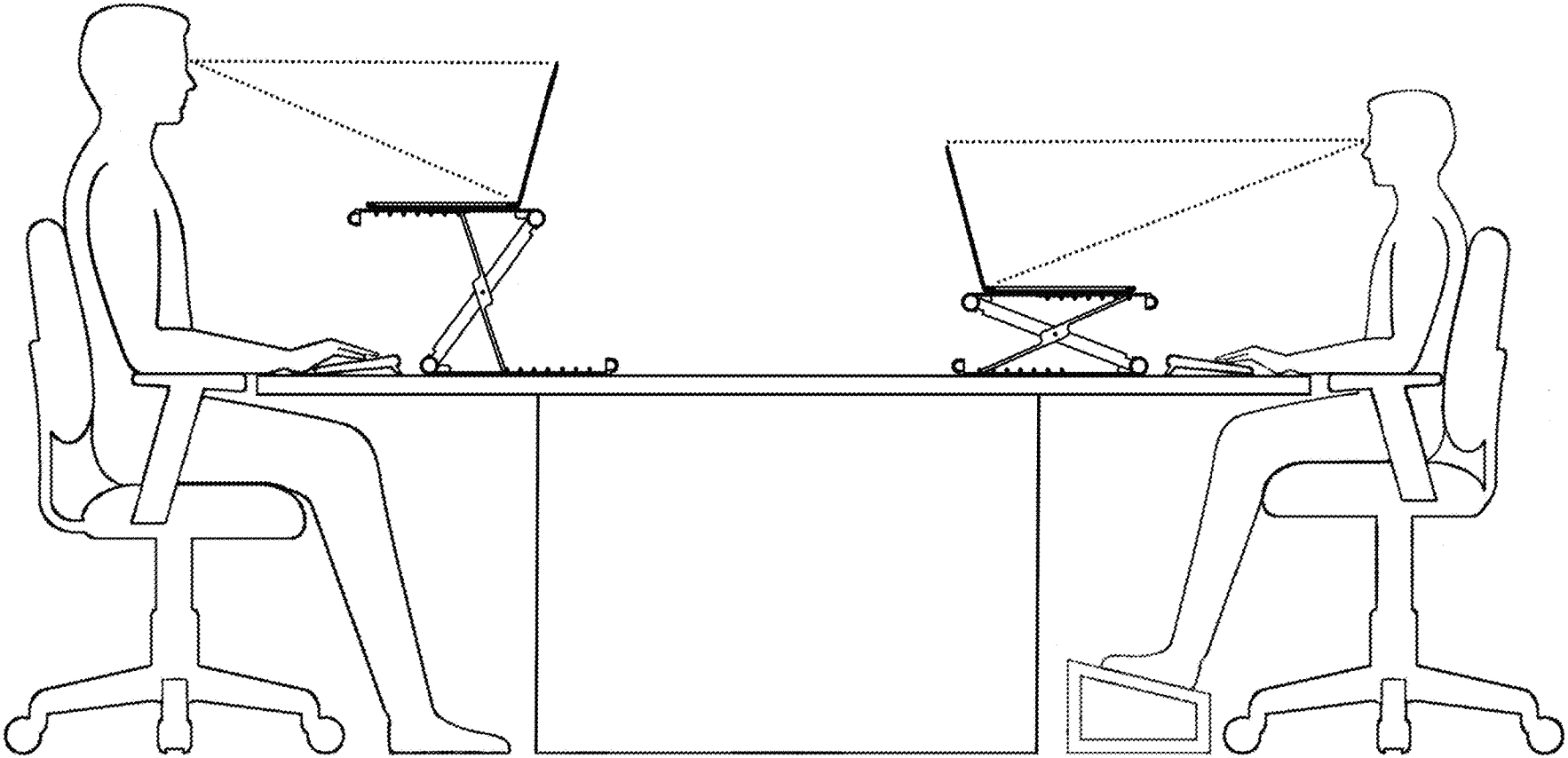
FIG. 5 is a schematic view showing the embodiment of FIG. 3, with two users of different heights in the healthy ergonomic position.

This way, the user can work according to the ergonomic rules, as illustrated in FIG. 5. As it can be seen, the different height of the eyes can determine the height of the raiser, with no risk for the user of taking unhealthy positions.

Figure 7:
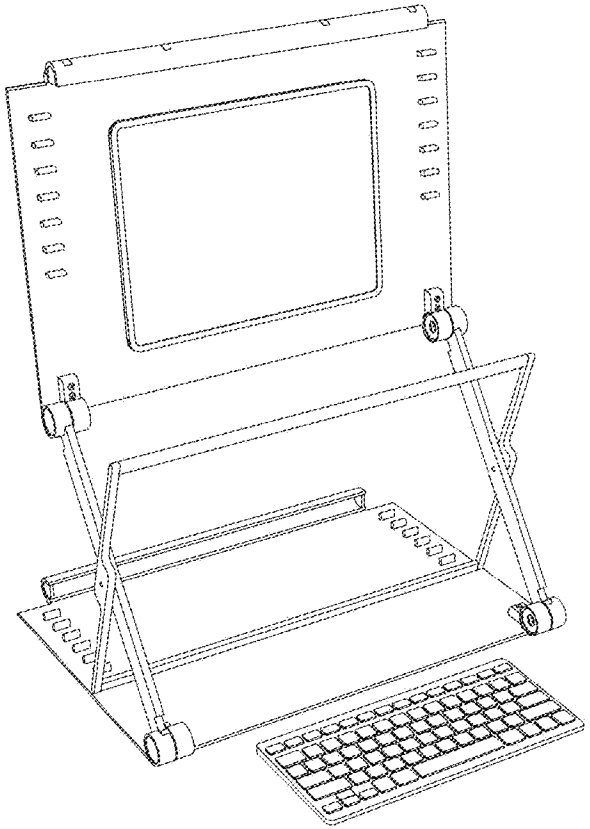
FIG. 7 is a perspective view of the embodiment of FIG. 6, in the working position.
Figure 6:
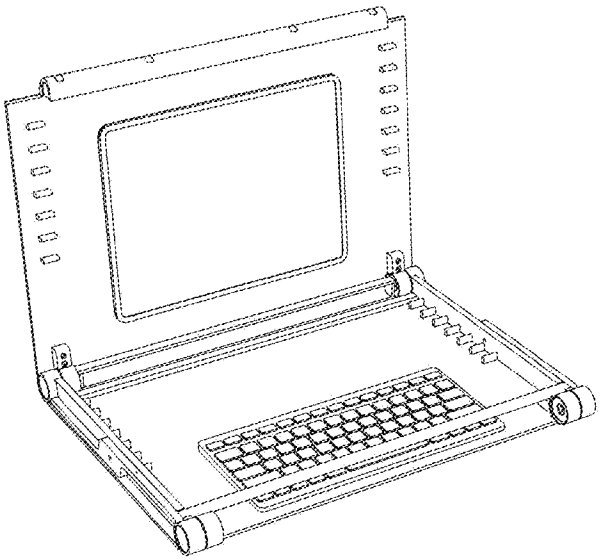
FIG. 6 is a perspective view of a second embodiment of the invention, wherein a tablet and a keyboard are provided.
Figure 8:
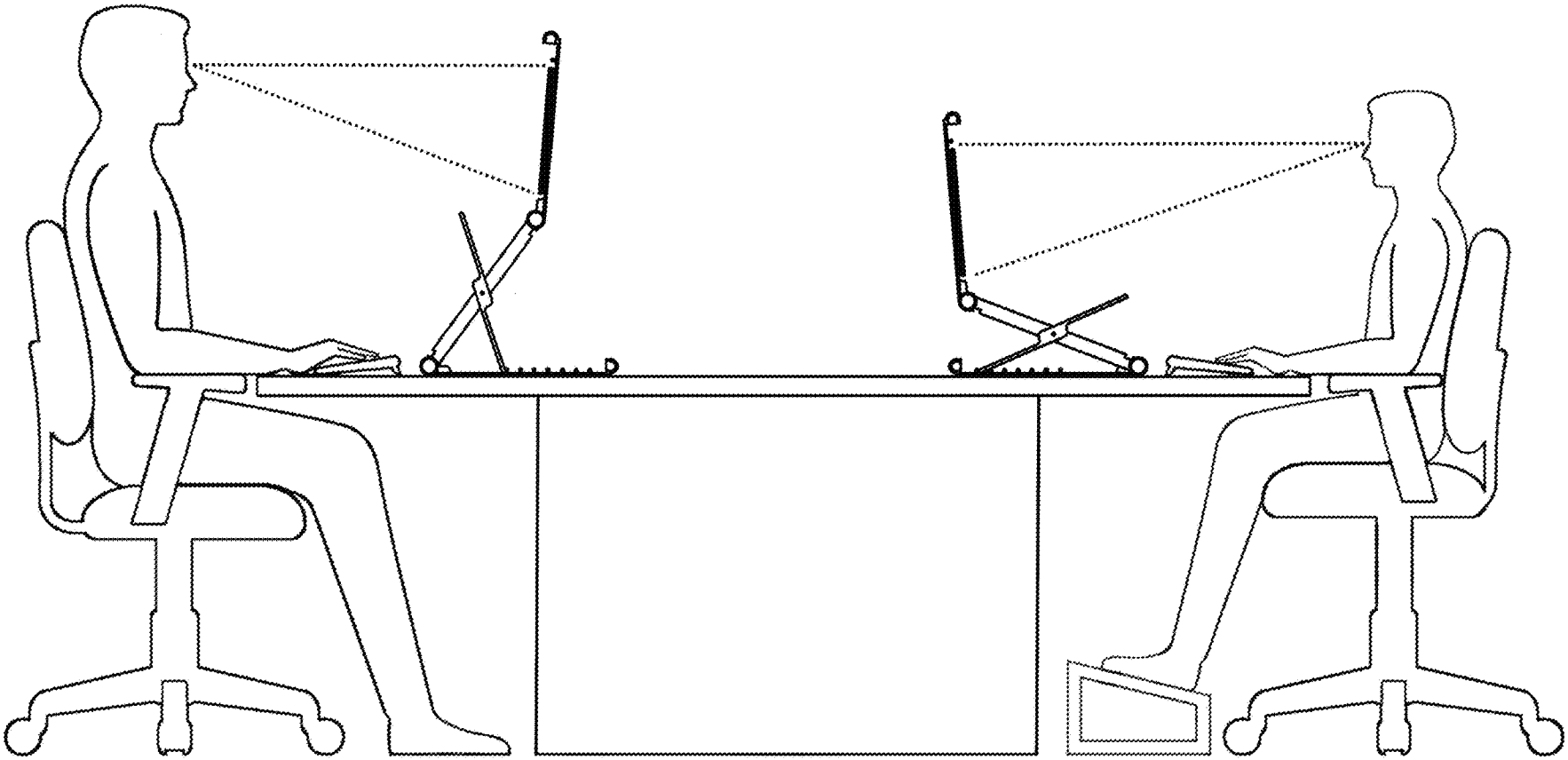
FIG. 8 is a schematic view showing the embodiment of FIG. 6, with two users of different heights in the healthy ergonomic position.

In the version for tablets which is generically illustrated in FIGS. 6 to 8, the tablet is in engagement with the inner surface of the upper flap 2. The user could decide to work as illustrated in FIG. 6 without arming the raiser, or in the same manner as described for laptops, avoiding a complete rotation of the upper flap 2: the tablet weight is sufficiently light to sustain the vertical position, or to maintain a slightly rotated position, if required, to obtain the correct and preferred angle of use, without the need of other supports. As shown in FIG. 8, the screen height will be defined by the specific notch occupied by the frame: the arm 8 will be accordingly rotated.

Several elements are innovatively provided to better define the scope of the invention.

Figure 9A:
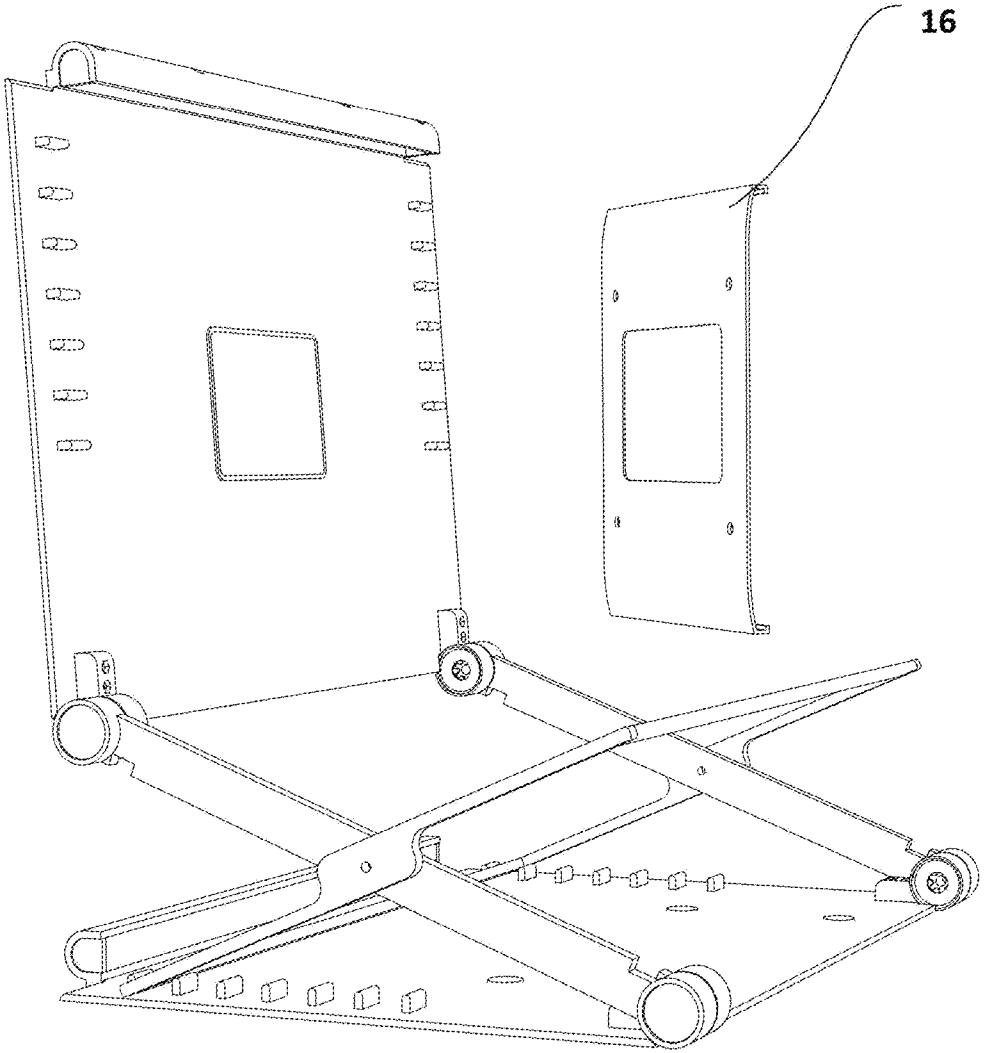
FIGS. 9*a* and 9*b* are two perspective views of a first specific solution embedded in the second embodiment of the invention.
Figure 9C:
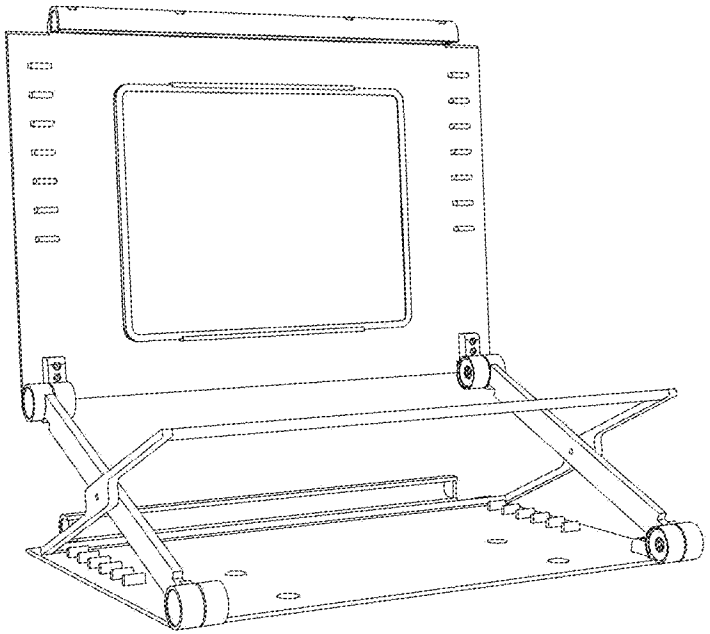
Figure 9B:
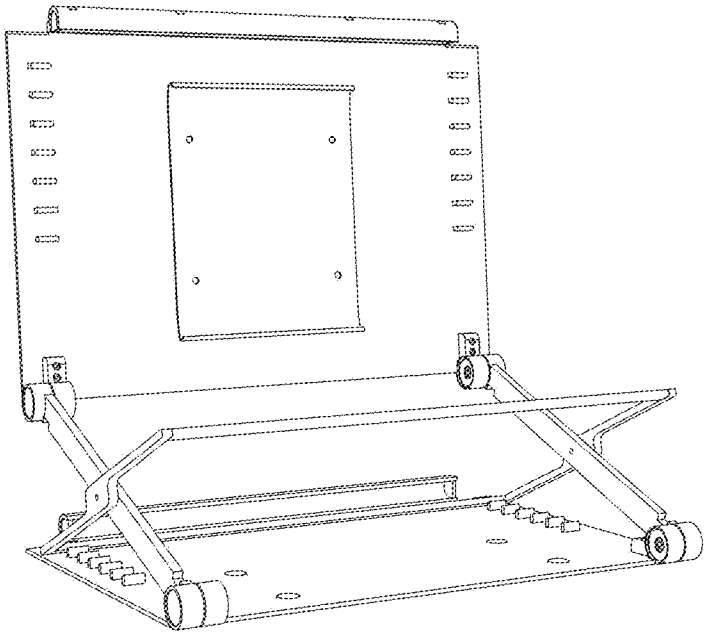

First, FIGS. 9*a* to 9*c* describe a bracket 16 provided with two appendixes apt to set the tablet in the correct position. Said bracket is provided in the centre of the upper flap 2 and it is fixed to the flap 2 by means of screws or other useful mechanical engagement elements. In an alternative solution illustrated in FIG. 10, a magnetic element 17 replaces the bracket 16 onto the flap 2 and a complementary magnetic element is provided on the tablet surface. The engagement between the tablet and the flap is therefore obtained.

Figure 10:
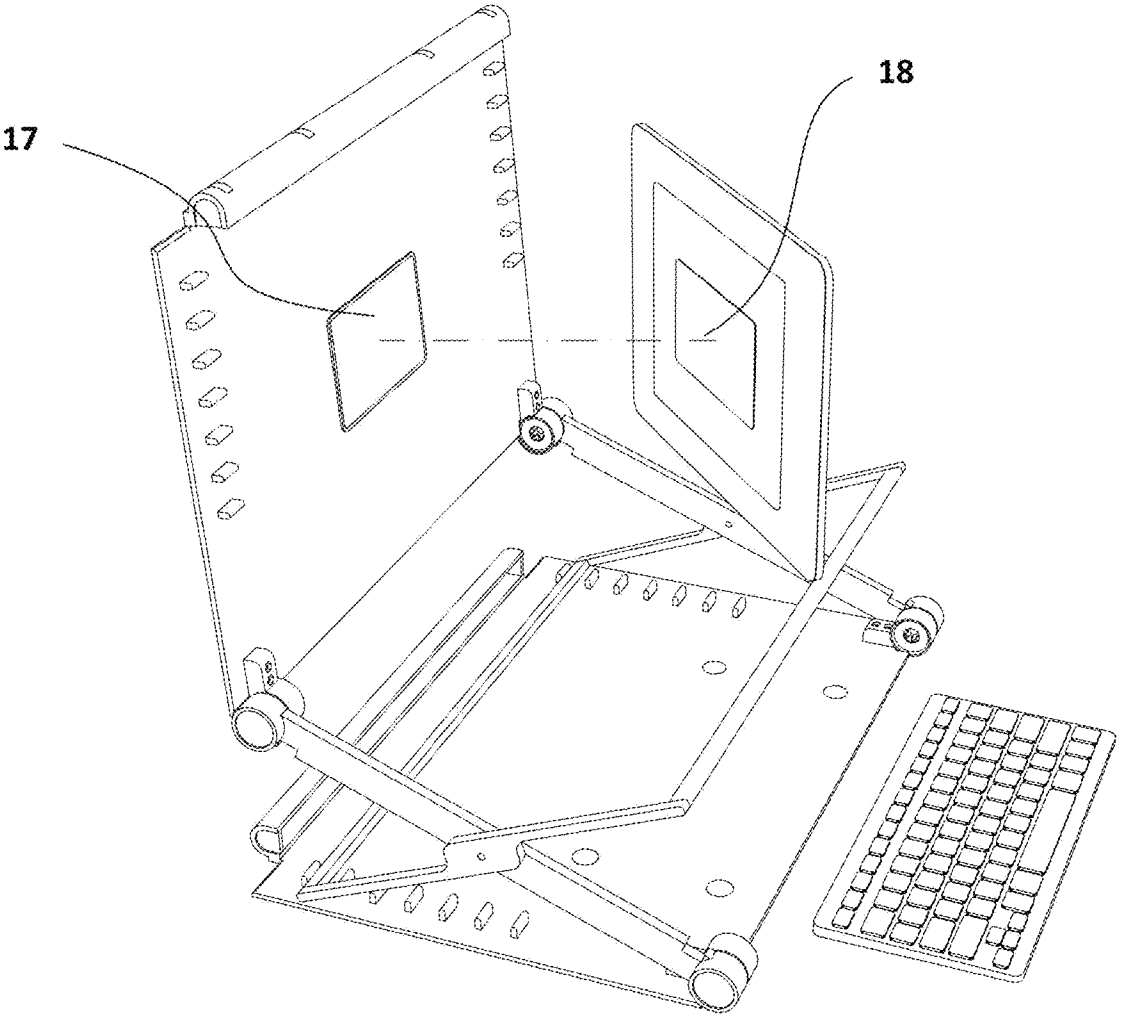
FIG. 10 is a partly exploded view of a second specific solution embedded in the second embodiment of the invention.
Figure 11D:
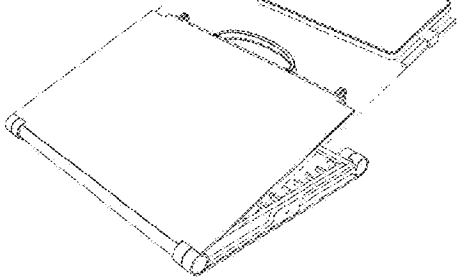
FIGS. 11*a* to 11*d* are views showing a first solution provided for the connection of external devices into the bag outer surface.
Figure 11C:
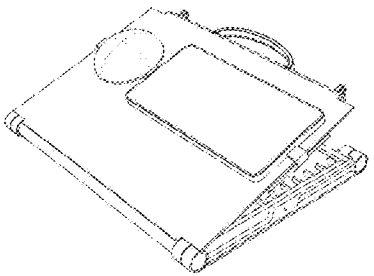
Figure 11B:
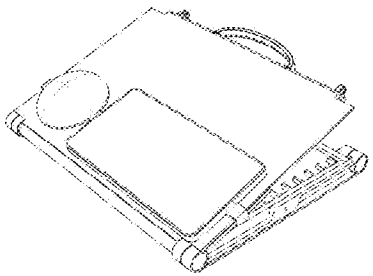
Figure 11A:
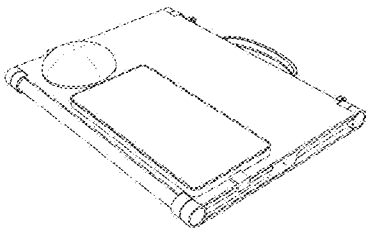

Furthermore, connection elements can be arranged for each device (such as the keyboard with magnets) and anchor points on the flaps, either internally or externally, such as the four holes in FIG. 10. The connection between the devices and the bag surfaces can be magnetic or can also be for example in the form of a mechanical connection.

In FIG. 11*a* to 11*d* an external containing element 19 is showed arranged on the flap 2, characterized by two separate compartments, to contain for example a mouse and a keyboard. The shapes of this type of container can vary in the number of compartments, in the dimensions, as well as in the position with respect to the flap 2 surface. Such containing element is slidable along the flap 2, to be detached therefrom.

Figure 12B:
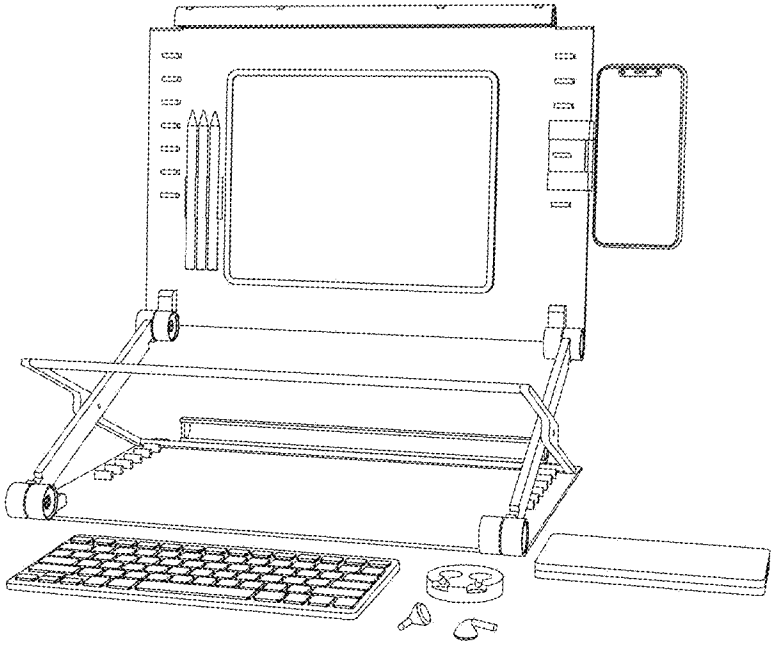
Figure 12A:
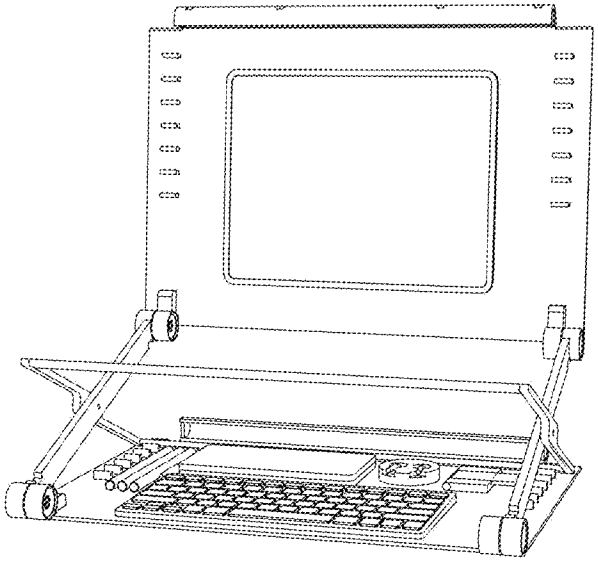
Figure 12C:
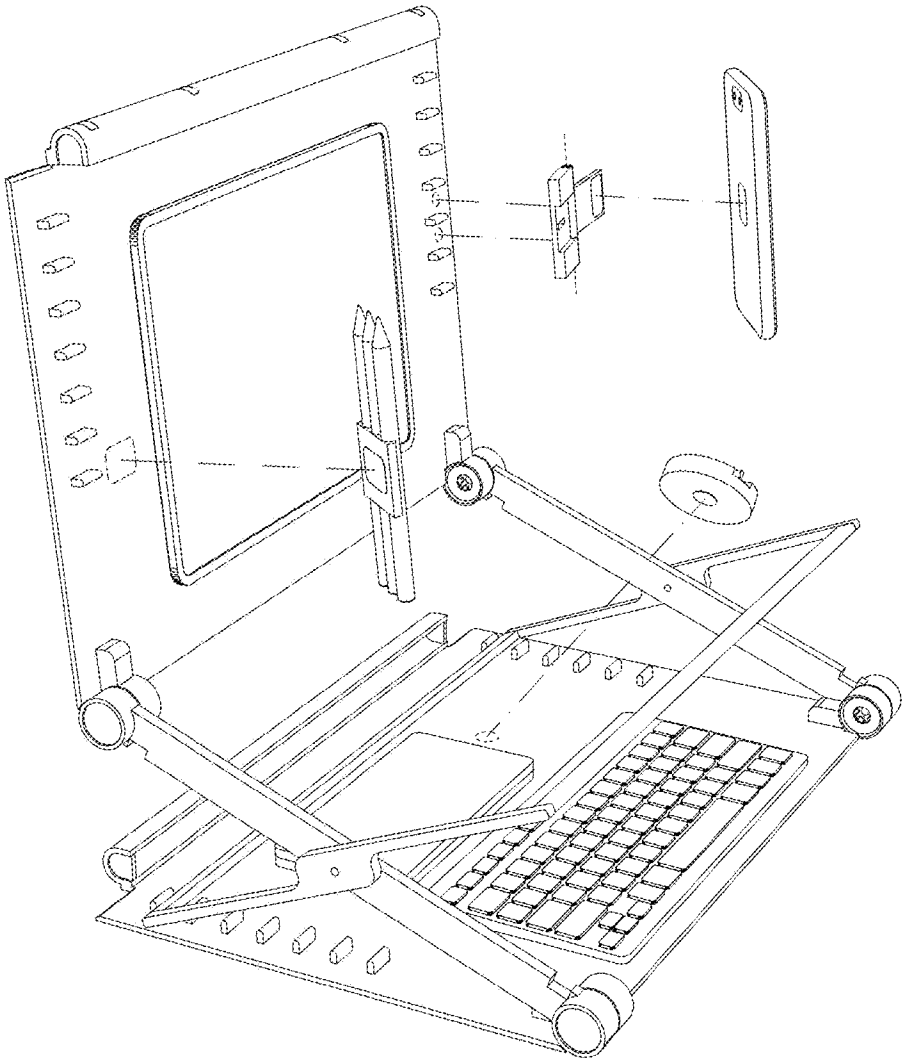
Figure 13C:
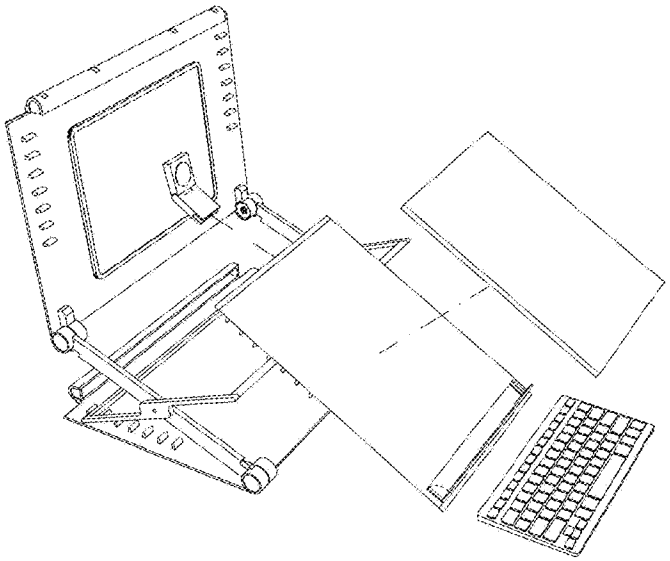
FIGS. 13*a* to 13*d* are views showing a second solution provided for the accommodation of external devices inside the case.
Figure 13B:
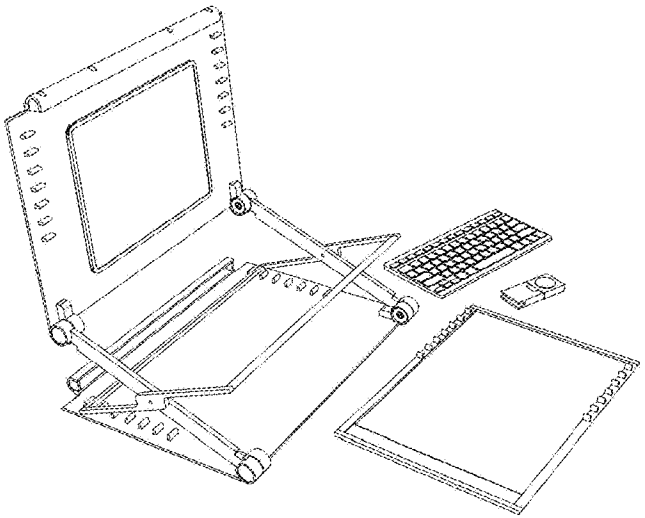
Figure 13A:
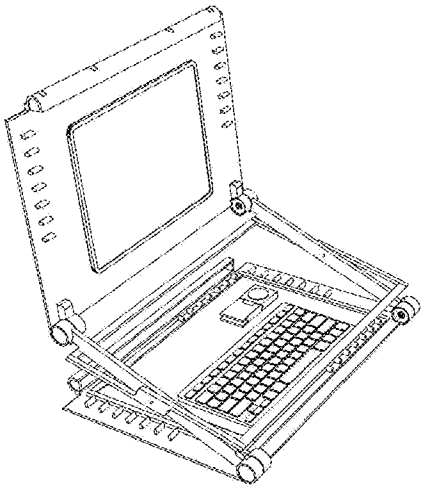
Figure 13D:
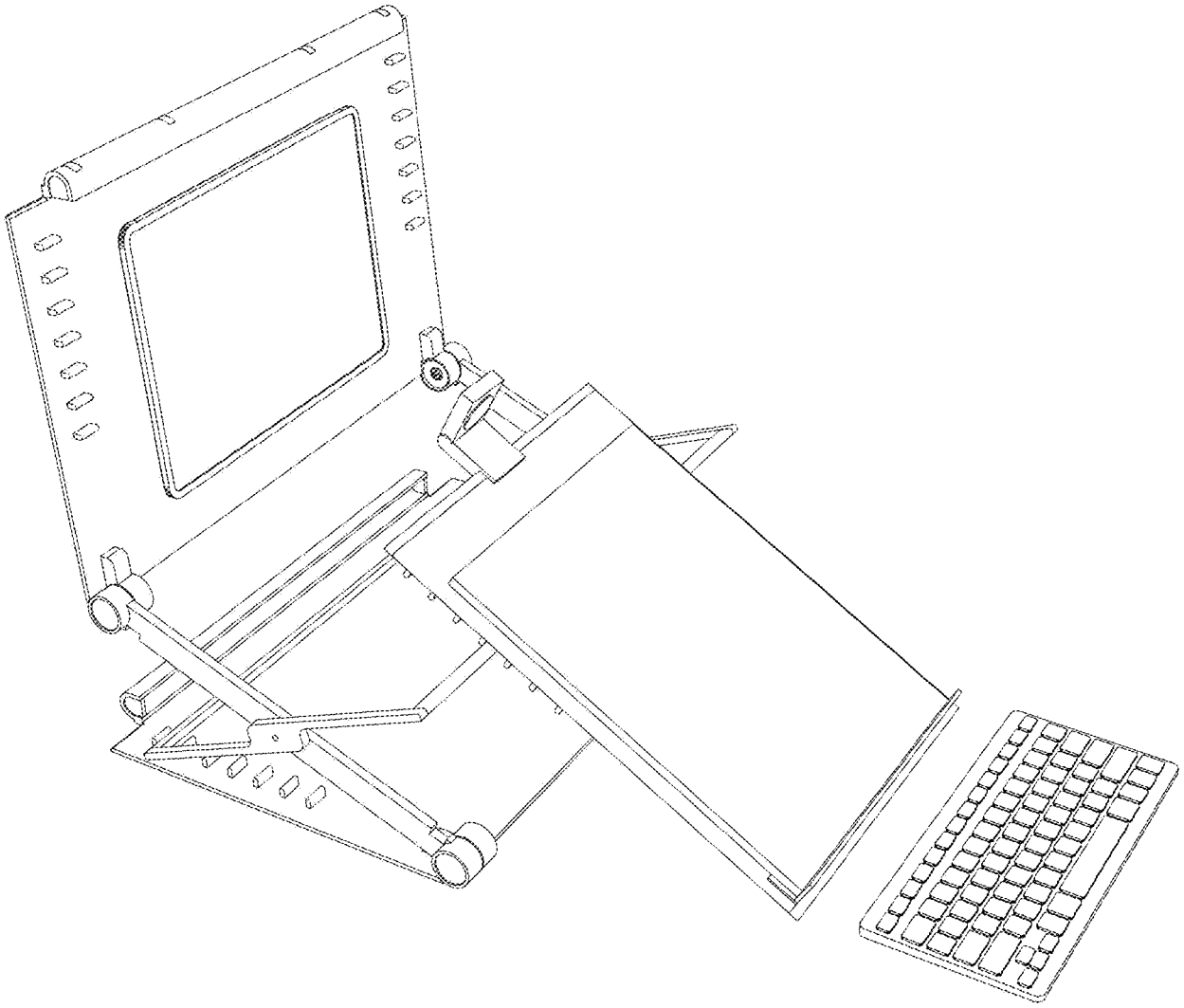

FIGS. 12*a* to 12*c* provide a set of devices useful to work in a provisional office in the best way: a magnetic-base pen holder and a phone holder (smartphone) adjustable in inclination, to be attached to the notches 13 at different heights, a magnetic-base keyboard, a magnetic-base mouse, a storage box, and a magnetic-base earphone case. All these removable devices can be arranged on an upper flap 2 and a lower flap 3, in different positions. The connection between the devices and the bag surfaces can be magnetic or can for example also be in the form of a mechanical connection.

Figure 14B:
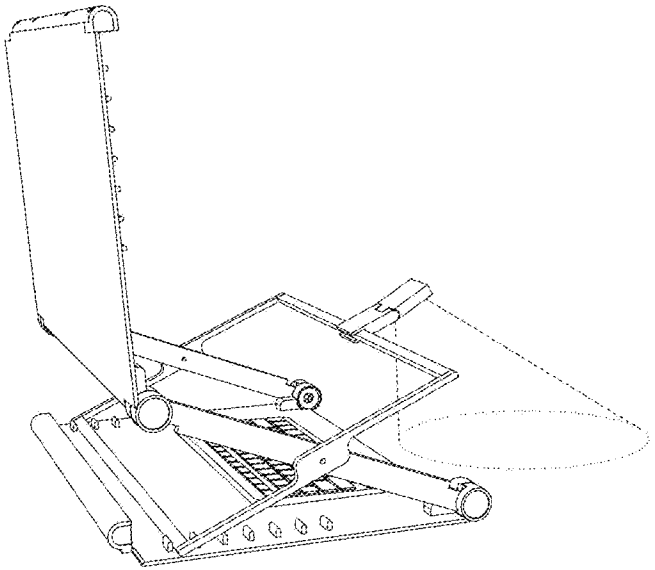
FIGS. 14*a* and 14*b* are views showing a solution apt to insert a torch in correspondence of the work area.
Figure 14A:
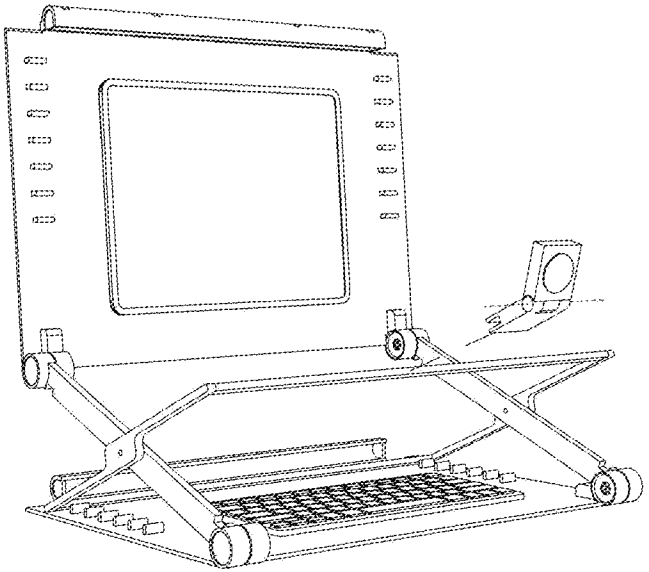

Furthermore, FIGS. 14*a* and 14*b* show the solution of a foldable, adjustable torch to be mounted onto the frame 9, to illuminate the working and reading surface. It is possible to combine the torch with a briefcase adjustable in inclination that could have engagement elements to be attached to said frame 9, as illustrated in FIGS. 13*a* to 13*d*.

In the embodiment illustrated in FIGS. 14*a*-14*b*, the torch is directly connected to said frame 9, without the presence of other elements: this solution, obtained for example by a tightening collet provided on the rear part of the torch, or by a magnetic coupling, could give the user the opportunity to do without a table light which in many cases is particularly bulky.

Figure 15B:
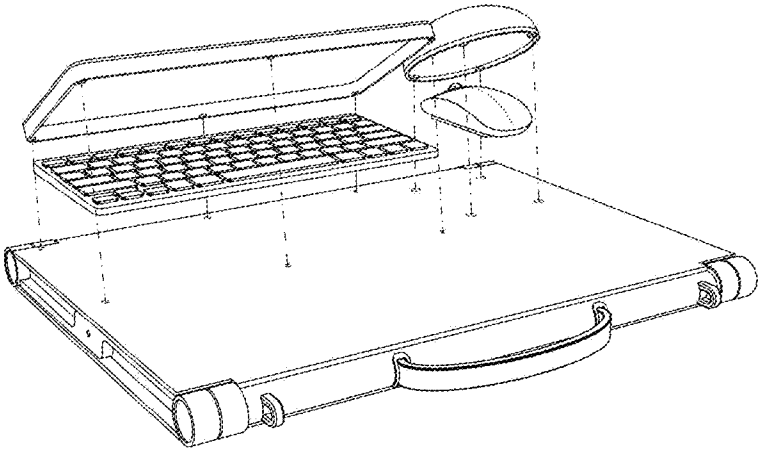
FIGS. 15*a* and 15*b* are views showing a second solution provided for the connection of external devices into the bag outer surface.
Figure 15A:
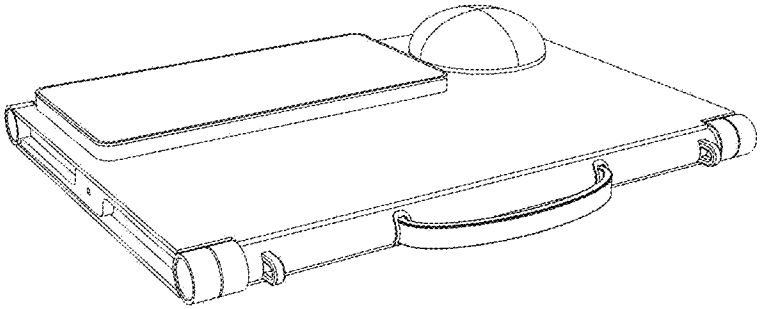

FIGS. 15*a*-15*b* show external devices enclosed in specific cases and maintained in the correct position outside the bag using magnetic means, or for example a mechanical connection, conveniently arranged along their surface.

This is done to carry the greatest number of products/accessories available on the market (e.g., keyboard, mouse) when, due to their shape or size, it is impossible to store them inside the bag.

Figure 16B:
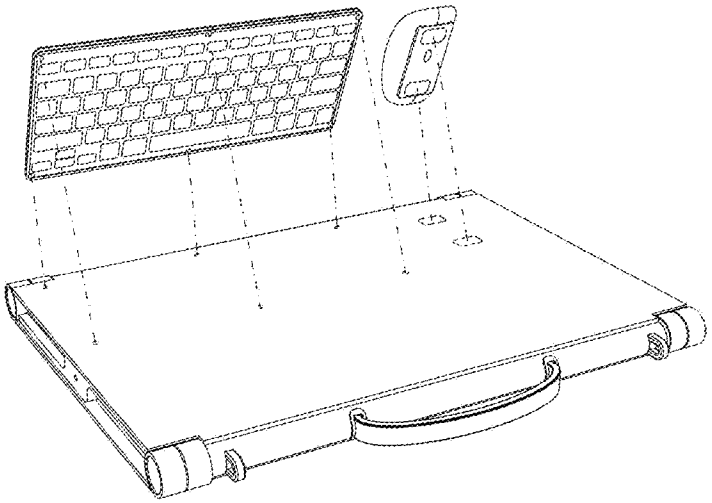
FIGS. 16*a* and 16*b* are views showing a third solution provided for the connection of external devices into the bag outer surface.
Figure 16A:
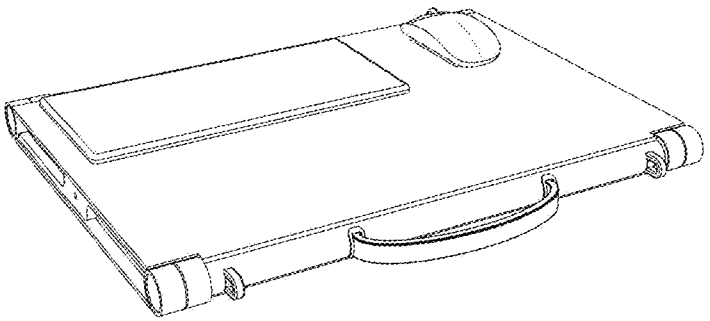

FIGS. 16*a*-16*b* relate to certain new products specifically designed for the bag for electronic devices (for example a detachable keyboard or mouse through a magnetic system).

In an alternative embodiment, shown in FIGS. 17*a*-17*b* the frame 9 is hinged to the arm 8, and comprises two symmetrical semi-arms held in mutual engagement by means of a hinge 20 arranged on the upper surface, to allow rotation until the front portion of the frame 9 itself overlaps its rear portion.

This particular feature allows to bring the arm 8 into a folded position, granting a full range of movement onto the flap 2 internal plane, in order for example to write on a keyboard, without affecting in any way the stability of the electronic device support system.

Figure 18B:
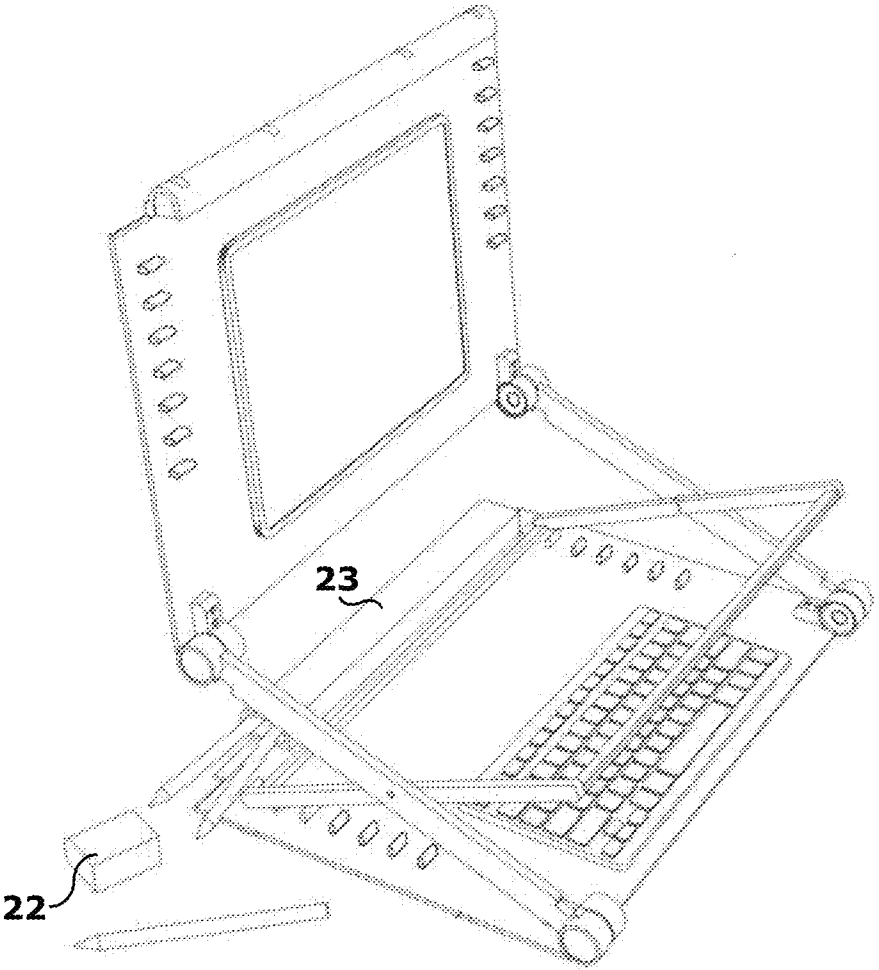
FIGS. 18*a* and 18*b* and FIGS. 19*a* and 19*b* are views showing two different additional solutions for the accommodation of external devices inside the case.
Figure 18A:
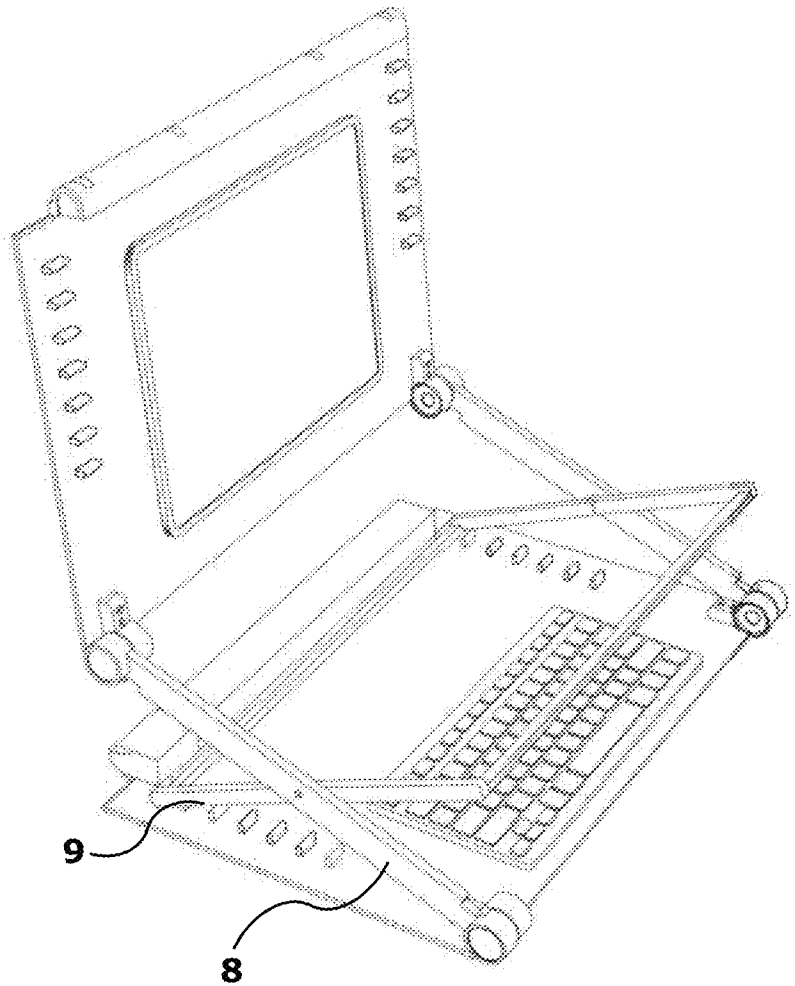
Figure 19B:
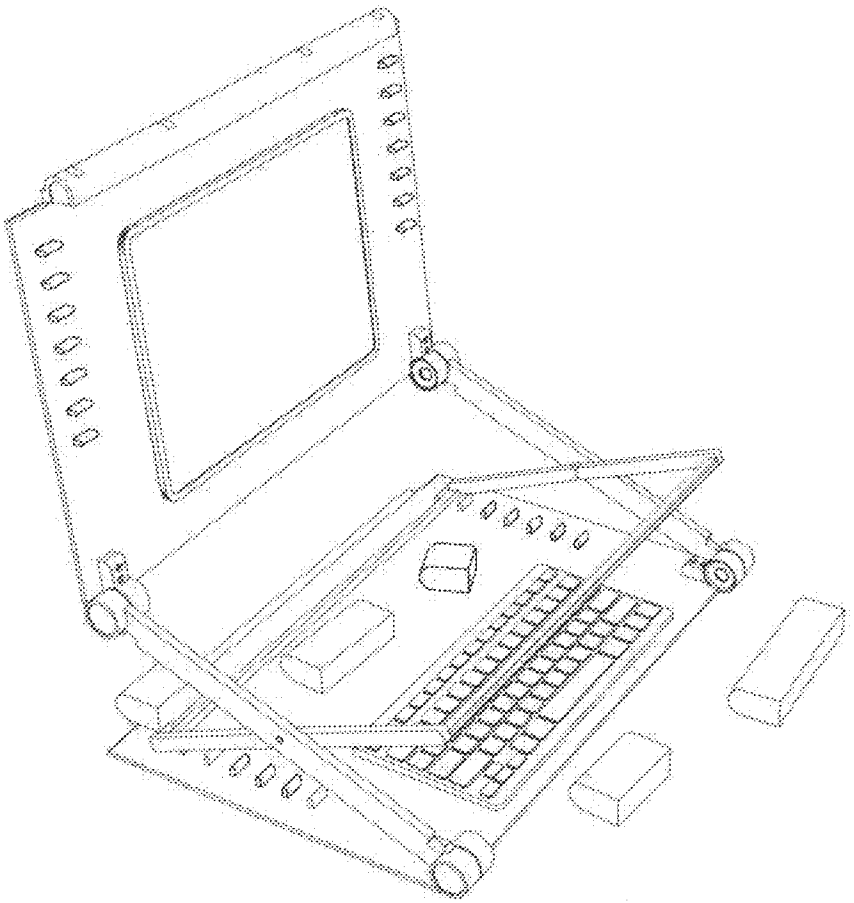
Figure 19A:
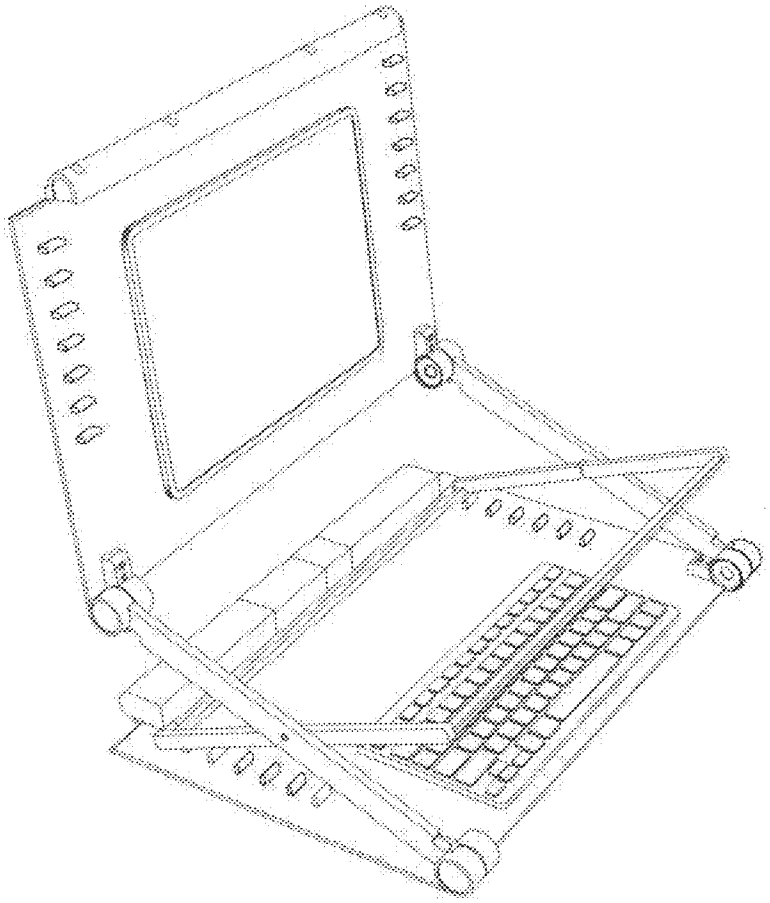

In further alternative embodiments, with or without the feature used in FIG. 17, means for housing objects 21 are provided, such as for example a case, equipped with a closing cap 22, as illustrated in FIGS. 18*a*-18*b*, or a succession of modules 23, detachable and repositionable by means of magnetic or mechanical means, said modules being able to contain power banks, housings and recharges for radio receivers, speakers, and the like, as needed.

The invention has been described in some specific and preferred embodiments, but in a sufficient wealth of details to appear clear to a medium expert of the art. The object of invention has been achieved: as a matter of fact, an external device has been realized which allows for the user to raise the height of the screen, to control the angle of the screen, to use a separate keyboard and mouse.

In addition, the device has an adequate height range to bring the screen to a correct viewing height and allow for adjustment of the screen angle—which is very important to establish a comfortable viewing experience, avoid the glare, and be able to adjust from user to user.

Furthermore, the device allows for portability, which is a key feature, since in case of sanitary isolation users must work inside their and once the office activity resumes, there are many companies that require a hybrid work model which alternates between office and homework.

Furthermore, it is a device that allows for ample ergonomic positions and adjustments, is portable and lightweight and can also serve as the carrying case for laptop and tablet. The invention described above can be implemented in many different ways, which are not part of the present description, but which are included within the scope of the invention as defined in the attached claims.

The invention claimed is:

1. A bag (1) for electronic devices comprises a pair of facing rectangular flaps (2, 3), each of said flaps being provided with a respective appendix (4, 5) at one end of its long side, said appendix (4, 5) having a semi-cylindrical profile, and with a couple of cylindrical hinges (6, 7) at the other end, in an inner surface, an arm (8) being fixed to each of said cylindrical hinges (6, 7), said arm (8) being connected to a frame (9) through a central pivot (10), both being arranged on the edges of the short side of said bag, wherein said frame (9) is hinged to the arm (8), and comprises two symmetrical pieces held in mutual engagement by means of a hinge (20) arranged on the upper surface, wherein a front semi-arm is configured to rotate inwardly and overlap a rear semi-arm so as to allow rotation until the front semi-arm overlaps the rear semi-arm of the frame (9).

2. The bag according to claim 1, wherein the appendixes (4, 5) are sufficiently long to meet said cylindrical hinges (6, 7).

3. The bag according to claim 1, wherein when the flaps are in a rest position, said arm (8) and a corresponding pivoted side of the frame (9) are configured to define a lateral side of the bag, due to a mutual overlapping of said arm (8) and said frame (9).

4. The bag according to claim 1, wherein notches (13) are provided in the inner surface of said flaps (2, 3), which are arranged in two parallel rows and apt to house the frame (9), and in that a plate (14) is provided at a centre of the upper flap (2), apt to engage a tablet.

5. The bag according to claim 1, wherein a bracket (16) is provided at the centre of the upper flap (2), equipped with two appendixes apt to set the tablet in a correct position, and configured to be engaged with the flap (2).

6. The bag according to claim 1, wherein a magnetic element (17) is provided on the flap (2) and a complementary magnetic element is provided on a tablet surface.

7. The bag according to claim 1, wherein anchor points are provided on at least one surface of at least one flap.

8. The bag according to claim 1, wherein housings for external devices such as mouse, keyboard, earphones, and the like are provided, said housings being containers (19) configured to engage with at least one of said flaps (2, 3), or a case provided with a closing cap (22), said housings consisting of a succession of detachable modules (23).

9. The bag according to claim 8 wherein the containers are configured to engage with at least one of said flaps by sliding, magnets, or screws arranged along a surface of said housings.

10. The bag according to claim 4, wherein a set of devices is provided inside the bag, internally or externally attachable to one of said flaps, said set of devices being at least one magnetic-base or mechanical-base element, selected from the group consisting of: a pen holder and a phone holder (smartphone) adjustable in inclination to be attached to said notches (13) at different heights, a keyboard, a mouse, a storage box, and an earphone case.

11. The bag according to claim 1, wherein a torch to be mounted onto the frame (9) is provided.

12. The bag according to claim 11, wherein said torch is configured to be attached into said frame (9) and adjusted in inclination.

* * * * *